US005964107A

United States Patent [19]

Chang

[11] Patent Number: 5,964,107

[45] Date of Patent: Oct. 12, 1999

[54] LOCK

[76] Inventor: Kuo-Chou Chang, No.97, Nan-Yang Road, Kaohsiung City, Taiwan

[21] Appl. No.: 09/066,552

[22] Filed: Apr. 28, 1998

[51] Int. Cl.[6] ..... E05B 67/36

[52] U.S. Cl. ..... 70/33; 70/226; 70/379 R; 70/398

[58] Field of Search ..... 70/225, 226, 233, 70/227, 228, 32–34, 38 R, 379 R, 380, 395, 397, 398, 401, 409, 377; 188/69, 31

[56] References Cited

U.S. PATENT DOCUMENTS

| | | | |
|---|---|---|---|
| 1,382,826 | 6/1921 | Dove | 70/398 X |
| 2,104,981 | 1/1938 | Falk | 70/33 |
| 2,438,435 | 3/1948 | Gagnon | 70/398 X |
| 5,211,044 | 5/1993 | Kim | 70/398 X |
| 5,265,451 | 11/1993 | Phifer | 70/226 |
| 5,335,520 | 8/1994 | Lee | 70/401 X |
| 5,365,758 | 11/1994 | Shieh | 70/226 X |
| 5,379,618 | 1/1995 | Shieh | 70/233 X |
| 5,402,660 | 4/1995 | Osada | 70/397 X |
| 5,511,400 | 4/1996 | Ma | 70/379 X |
| 5,517,837 | 5/1996 | Wang | 70/226 |
| 5,687,594 | 11/1997 | Wang | 70/377 X |

FOREIGN PATENT DOCUMENTS

| | | | |
|---|---|---|---|
| 337873 | 6/1921 | Germany | 70/398 |

*Primary Examiner*—Suzanne Dino Barrett
*Attorney, Agent, or Firm*—Dougherty & Troxell

[57] ABSTRACT

A lock includes a case having a shield, a locking member housing contained in a first chamber of the case and protected by the shield, a locking member contained in the locking member housing, a locking rod also contained in the first chamber of the case and moved by the locking member in locking and unlocking, and a deadbolt having a press portion and a rod portion with an annular groove for the end of the locking rod to engage in for locking. The locking member has a single or a double pin tumbler locking mechanism, or a disc tumbler locking mechanism.

13 Claims, 11 Drawing Sheets

LOCK

BACKGROUND OF THE INVENTION

This invention relates to a lock, particularly to one having a light weight, great strength, excellent anti-burglar and anti-strike feature, and low cost, with its pin tumbler locking mechanism well protected.

A conventional lock shown in FIG. 1 includes a U-shaped case 10 having a chamber 11, a locking member 12 contained in the chamber 11, a deadbolt 13 connected to an end of the locking member 12 and to be moved by the locking member to insert in a hole provided in the other end of the case 10, locking the lock.

FIGS. 2A and 2B respectively show the conventional lock in the locked and the unlocked position. The locking member 12 usually has a cylinder 121 rotatable, a number of pin tumblers 123 of different length and elastically and respectively pushed by the same number of springs 122, and the pin tumblers 123 obstructing a contacting line 124 formed between the locking member 12 and the cylinder 121 in case of the lock being in the locked position. If a correct key 125 is inserted in a key hole in the cylinder 121, the pin tumblers 123 are moved, not obstructing the separating line 124 permitting the cylinder 121 rotated to unlock the lock.

However, the conventional lock has an disadvantage of inferior anti-burglar function and weak structure caused by the feeble deadbolt 13 and the weak case 10.

Moreover, the convention lock has its pin tumblers 123 always protruding in an empty key hole in case of the lock locked so that the lock may be easily pried open or broken open by burglars. In addition, the pin tumblers 123 may be liable to wear off by frequent friction with the key 125, with accuracy between the key 125 and the pin tumblers 123 hard to maintain.

SUMMARY OF THE INVENTION

The purpose of the invention is to offer a lock of a light weight, great strength, excellent anti-burglar and anti-strike feature, and low cost, with pin tumblers well protected and having high accuracy to function in practical use.

The feature of the invention is a locking member and a deadbolt independently or coordinately used with a case, a locking member housing, and a locking rod.

The case has two chambers for containing respectively the locking member and the deadbolt. A horseshoe-shaped shield formed with a metal plate is provided to protect a case wall defining a deep opening provided in the case, having an upper and a lower sidewise projecting walls and a thicker intermediate bending wall.

The locking member housing is fitted in one of the chamber in the case, containing the locking member stabilized therein and on the horseshoe-shaped shield.

The locking member has a pin tumbler locking mechanism (a well known art), including an outer and an inner cylinder with a key. The outer cylinder has a number of pin holes for containing the pins therein and an inner cylinder fitted in the outer cylinder and having a center key hole and the same number of pin holes corresponding to the pin tumbler holes of the outer cylinder. The pins are movably fitted in the pin holes of both the outer and the inner cylinder and urged by a spring respectively put in the pin holes of the outer cylinder. When the lock is in the locked position, the pins have their other ends protruding across the contact ends to that contacting the springs protruding across line of both the cylinders to prevent the inner cylinder cylinder from rotation relative to the outer cylinder, i. e. in the locked position of the lock. Then if the key is inserted in the key hole of the inner cylinder, teeth of a tooth plate of the key may push the pins down to retreat in the pin holes of the outer cylinder, permitting the inner cylinder rotate relative to the outer cylinder, and then the inner cylinder is rotated to withdraw the locking rod to free the deadbolt, in other words, unlocking the lock.

The locking rod has one end affixed firmly with the locking member for engaging with and disengaging from the deadbolt when the locking member is rotated.

The deadbolt is movably contained in another chamber of the case, having a press portion and a rod portion extending from the press portion, and the end of the rod portion having an annular groove for the locking rod to engage therein in locking this lock.

Locking or unlocking of the lock is completed by the deadbolt and the locking member, but in order to position accurately the center point of the deadbolt, the locking rod, the case may be made of plastic or rubber.

BRIEF DESCRIPTION OF DRAWINGS

This invention will be better understood by referring to the accompanying drawings, wherein.

DETAILED DESCRIPTION OF THE PREFERRED EMBODIMENTS

Figure 1:
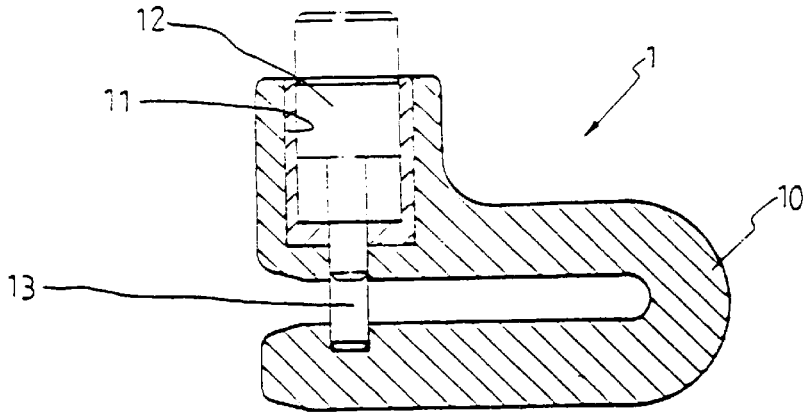
FIG.1 PRIOR ART
FIG. 1 is a cross-sectional view of a conventional motorcycle plate brake lock.
Figure 2A:
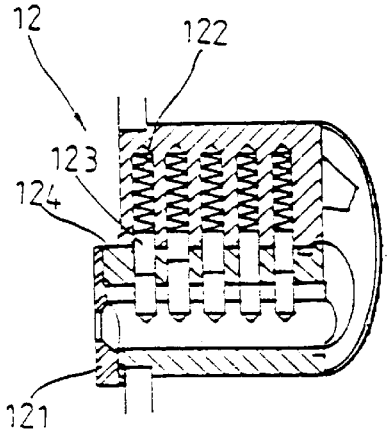
FIG.2A PRIOR ART
FIG. 2A is a cross-sectional view of the conventional lock in the locked position.
Figure 2B:
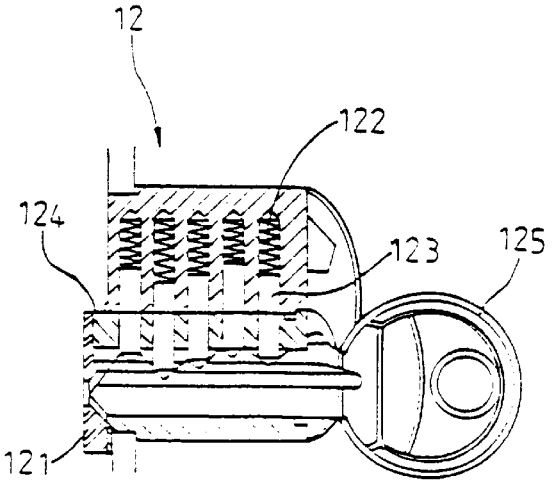
FIG.2B PRIOR ART
FIG. 2B is a cross-sectional view of the conventional lock in the unlocked position.
Figure 3:
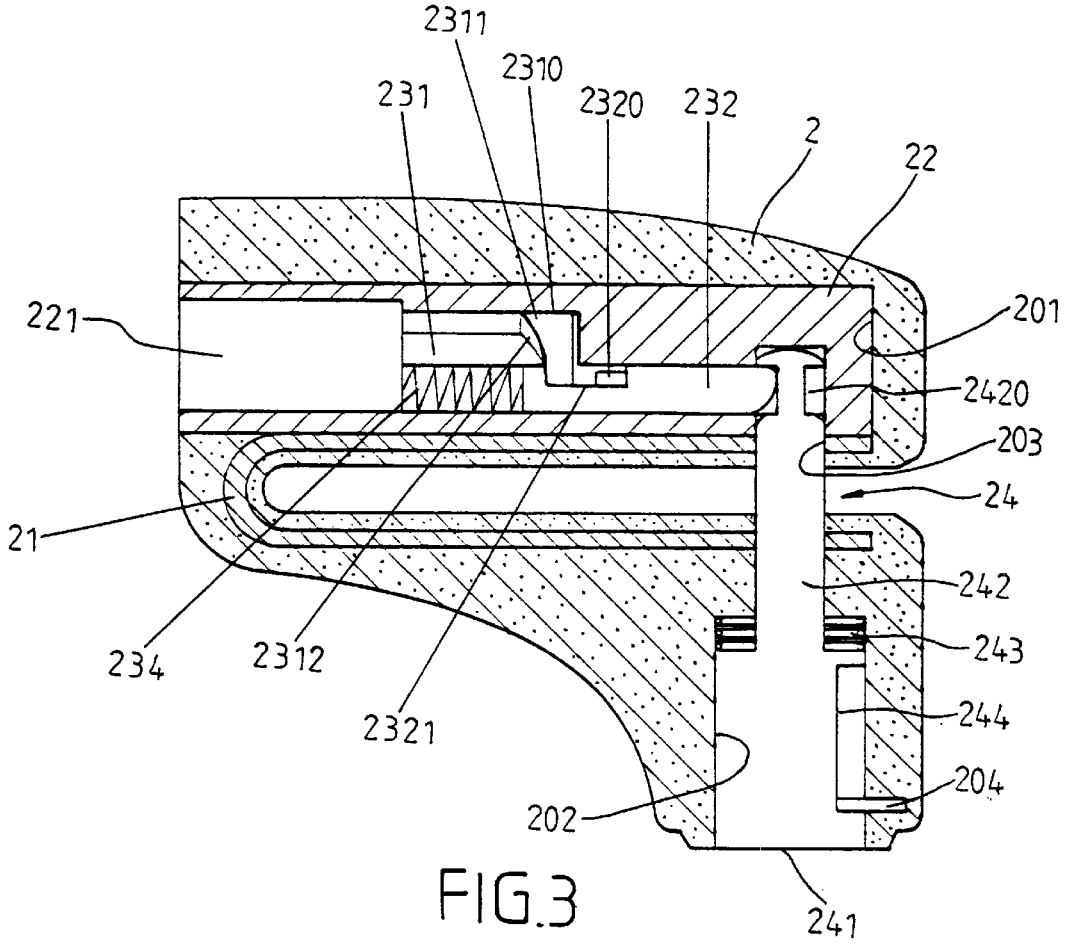
FIG. 3 is a cross-sectional view of a first embodiment of a lock in the present invention.
Figure 4:
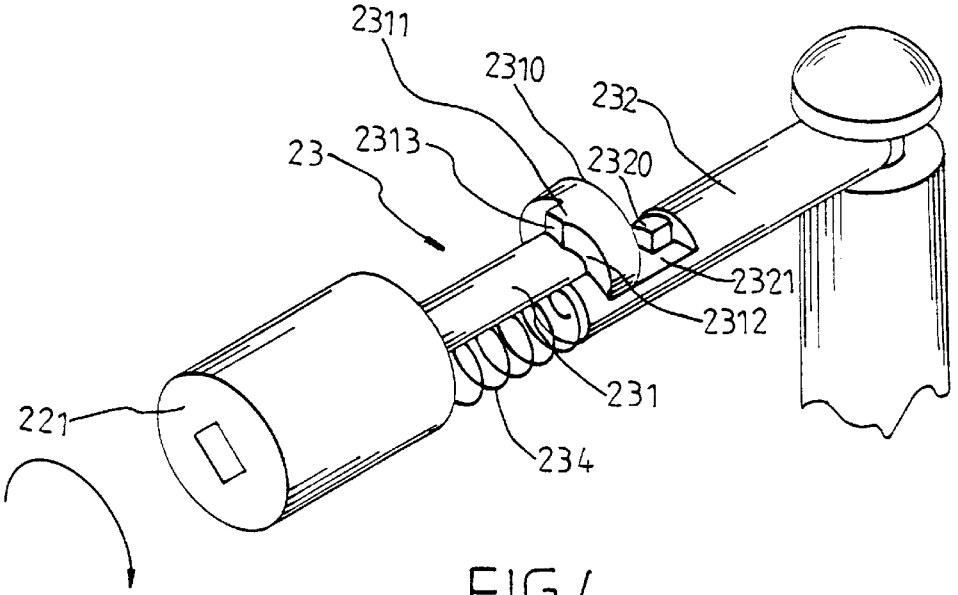
FIG. 4 is a perspective view of a locking rod of the first embodiment of a lock in the present invention.
Figure 5:
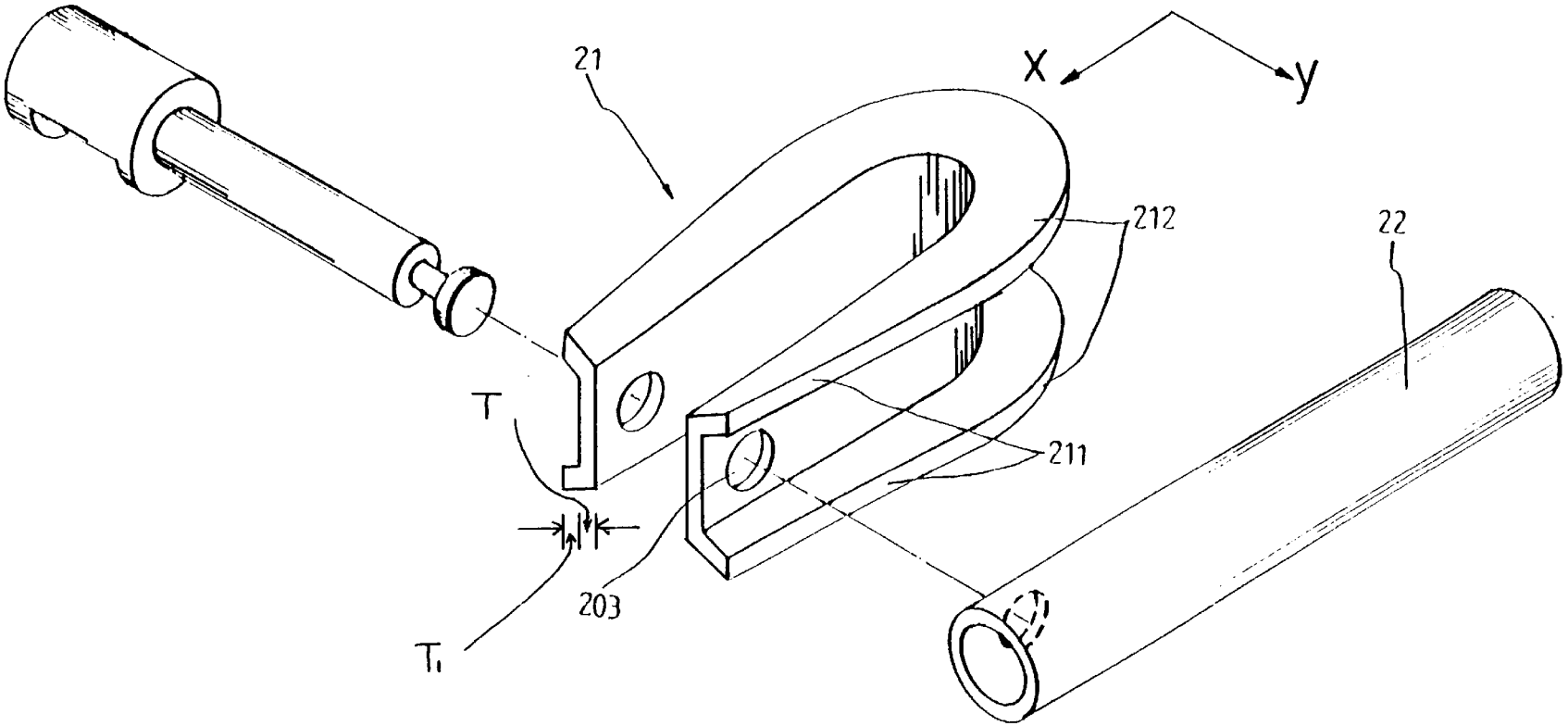
FIG. 5 is an exploded perspective view of a horseshoe-shaped shield, a locking member housing and a deadbolt of the first embodiment of a lock in the present invention.

A first embodiment of a lock in the present invention, as shown in FIGS. 3, 4 and 5, includes a case 2, a horseshoe-shaped shield 21, a locking member housing 22, a locking member 221, a locking rod 23, and a deadbolt 24 as components combined together.

The case 2 is U-shaped, having two chambers, a first one 201, a second one 202, in a corresponding or non-corresponding location, and the horseshoe-shaped shield 21 contained therein to protect a wall defining a center deep opening formed in the case 2.

The horseshoe-shaped shield 21 is formed of a metal plate, having a sidewise circumferential wall 211 extending respectively from an upper edge and a lower edge and provided with an intermediate portion 212 on the bending portion, and a bolt hole 203 bored respectively in two ends for the deadbolt 24 to pass through.

The locking member housing 22 is tubular, positioned in the first chamber 201 for containing the locking member 221 therein.

The locking member 221 is positioned in the locking member housing 22, operated to move the locking rod 23 to engage or disengage from the deadbolt 24 in locking or unlocking this lock.

The locking rod 23 has one end affixed with the locking member 221, performing engaging or disengaging the deadbolt 24 by rotating the locking member for a certain angle, say 90 degrees. The locking rod 23 has a transmitting portion 231 and a locking means 232 and a spring 234 located between the locking member 221 and the locking means 232.

The transmitting portion 231 of the locking rod 23 has one end fixed with the locking member 221 and the other end fixed with a disc 2310. The disc 2310 is located vertical having a nearly triangular projection 2311 on a front surface, and the projection 2311 has a a slope surface 2312 and a flat surface 2313 abutting on the slope surface 2312. The locking means 232 has a recess 2321 abutting the disc 2310.

The deadbolt 24 is movably positioned in the second chamber 202, passing through the bolt holes 203 of the shield 21, with its inner end possible to reach the inner end of the first chamber 201 for the end of the locking means 232 of the locking rod 23 to engage. The deadbolt 24 has a larger diameter press portion 241 and a small diameter rod portion 242 extending from the press portion 241 inward. A spring 243 is provided around the rod portion 242 and just urging the inner end of the press portion 241. The rod portion 242 has an annular groove 2420 near its inner end, and the press portion 241 has a side recess 244 for limiting the moving distance of the deadbolt 24.

The press portion 241 of the deadbolt 24 has an outer end surface rather large enough for pressing manually inward so as to let the annular groove 2420 engaged by the locking means 232 of the locking rod 23. In order to facilitate the rod portion 242 of the deadbolt 24 move in and out for locking or unlocking, a pin 204 provided at an outer end of the recess 244 of the press portion 241 and protrudes sidewise in the recess 244. Then the deadbolt 24 may be moved only in the length of the recess 244 and stopped by the pin 204 in moving out and in, not falling out of the chamber 202.

The horseshoe-shaped shield 21, as shown in FIG. 5, is made of a metal plate of a proper thickness, having a wedge-shaped cross-section. The metal plate has a thickness T, and the sidewise projecting walls 211 formed in press process has a thickness T1 so that the shield 21 itself has a thickness T+T1, in other words, the wedge-shaped cross-section has the thickness T+T1 and strength the same as a solid to resist illegal prying action of a burglar, with the sidewise projecting walls 211 resisting horizontal-direction force and a vertical-direction force (their coordinates based on X and Y shaft shown in FIG. 5).

In order to strengthen the shield 21, the intermediate sidewise walls are provided to connect to two side projecting walls 211 formed on the bending portion of the shield 21, raising up its striking or prying resisting strength. Moreover, heat treatment can be performed to the shield 21 to beef up its material strength.

The anti-burglar and anti-striking and anti-prying effect of the first embodiment of a lock is to be described below.

The locking member housing 22 and the deadbolt 24 are respectively contained in the chambers 201, 202 and the locking means 232 may have its inner end fitting in the annular groove 2420 of the rod portion 241 of the deadbolt 24 by resilience of the spring 234 so that the locking means 232 may not disengage from the annular groove 2420 by means of pressing, no matter how the deadbolt 24 may be rotated. Then this lock is prevented from unlocked by such an illegal prying action.

Under the above-described condition of the locking member 22, the recess 2321 of the locking portion 232 urges the disc 2310 of the transmitting rod 231 in the locked position. In order to prevent the locking member 221 from struck open, a buffer block 2320 is added to the side vertical wall defining the recess 2321, able to tightly contact the disc 2310 of the transmitting rod 231. Thus the locking means 232 cannot retreat to the locking member 221 to become unlocked by inertia when struck illegally.

If the lock is to be unlocked, the correct key is inserted in and rotated to rotate for a certain angle the locking member 221, with the disc 2310 of the transmitting rod 231 and the flat projection 2311 rotated to go nearer the locking means 232. Then the slope surface 2312 moves between the disc 2310 and the locking means 232 and accordingly forces the locking means 232 move to a certain point nearer to the locking member 221. Then the flat surface 2313 of the flat projection 2311 contacts and keeps immovable the locking means 232, with the locking means 232 disengaging from the annular groove 2420 of the deadbolt 24, which is then pushed instantly outward in the chamber 202 by the spring 243 recovering its resilience. At the same time, the deadbolt 24 can be stopped by the pin 204, not wholly ejected out of the chamber 202.

Figure 6:
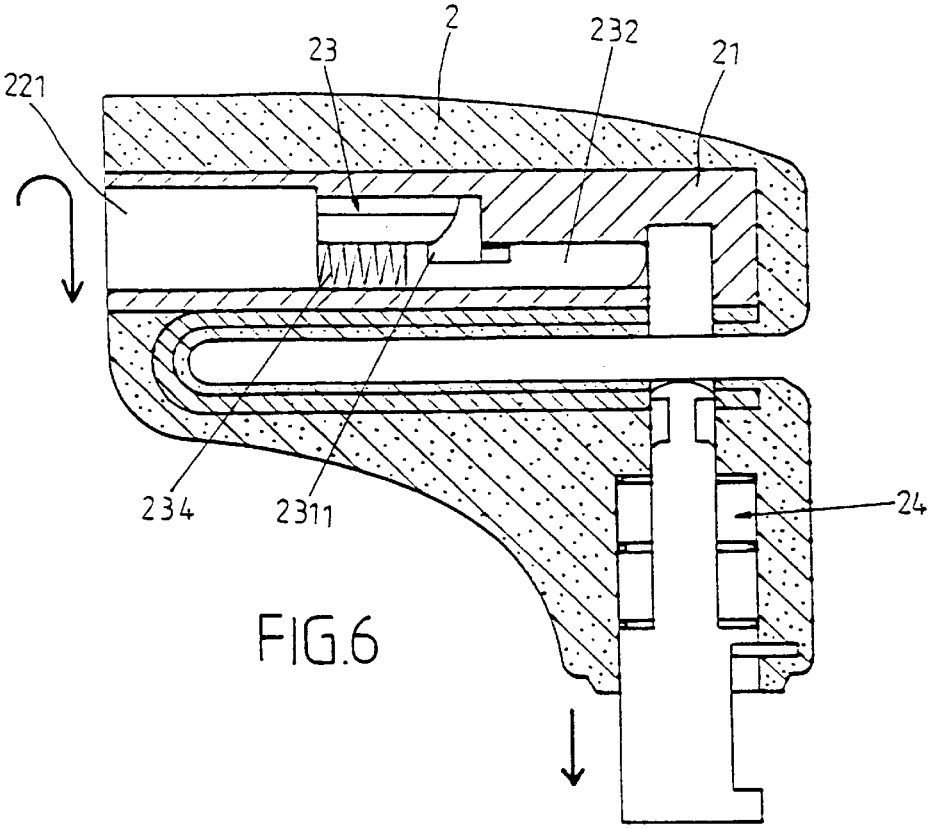
FIG. 6 is a cross-sectional view of the locking rod in the unlocked position in the present invention.

After the locking means 232 is retracted to perform unlocking of the lock as shown in FIG. 6, the locking member 221 is rotated with the correct key again to permit the locking means 232 move to the locked position by the spring 234, with the flat portion 2311 not sticking the locking means 232. Then the deadbolt 24 is pushed in, letting the annular groove 2420 engage the locking portion 232 in the next locking action, without using the correct key again, which is one of the feature designed in the present invention.

The locking member housing 22 with the locking member 221 contained therein and the deadbolt 24 in the invention can be used as an independent lock, with the deadbolt 24 passing through the hole of a motorcycle plate brake and engaged with the locking member 221.

The case 2 is provided to contain the locking member housing 22 and the deadbolt 24 so as to make the lock easy to use and to beautify its outer appearance, and to position the the deadbolt 24 just to align to the center of the deadbolt hole 203 so as to push inward the deadbolt 24 through the deadbolt hole 203 only with one hand in locking. The anti-theft function is performed by the locking member 221 and the deadbolt 24, so the case 2 can be made of a strong plastic or rubber instead of a metal as used in common locks for protecting the locking member housing 22 and the deadbolt 24. Thus, it can not only give aesthetic feeling, but also protect the other components from broken or pried open illegally, so various kinds of locks can be designed to cope with market demands. Even the case 2 should be sawed open, the locking member housing 22 and the deadbolt 24 are still in the locked position, preventing an object locked by this lock from stolen.

Common lock makers mostly utilize metal to make the case of a lock, but metal is generally expensive, and hard to process as well. The cage in the present invention can be made of cheaper material such as plastic or rubber because of the provision of the locking member housing 22, which is one purpose of the invention.

Figure 7:
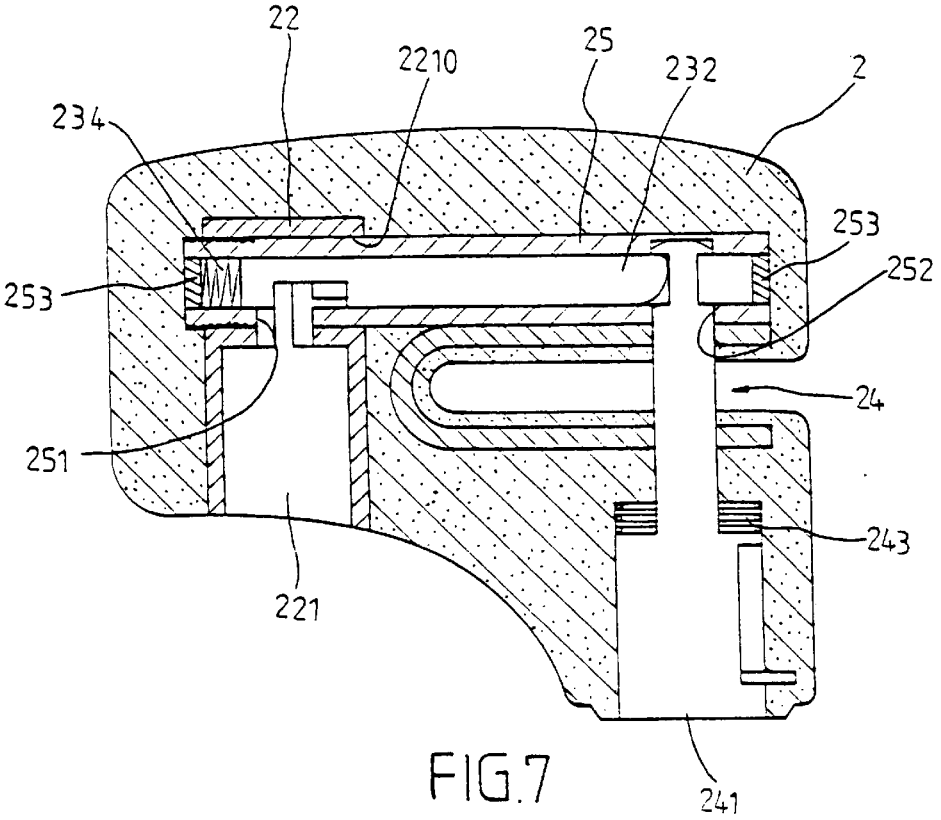
FIG. 7 is a cross-sectional view of a second embodiment of a lock in the present invention.

A second embodiment of the lock in the present invention is shown in FIG. 7, includes a case 2, a locking member housing 22 and a deadbolt 24 the same as those in the first embodiment. In order to adapt to various size of a motorcycle plate brake, the recess 2321 of the locking means 232 is especially provided to face in the direction of the deadbolt 24, and the locking member 221 is positioned in a right angle i.e. in an L-shape, toward the locking means 232 and in parallel to the deadbolt 24.

In order to facilitate the locking member housing 22 made, a hole 2210 is provided in the locking member housing 22 for a tube 25 to fit therein, and the tube 25 has its interior for containing the locking means 232, taking place of the interior of the locking member housing 22 in the first embodiment. And the partial inner wall of the locking member housing 22 and the left inner wall of the tube 25 are threaded to engage with each other so as to combine the both 22, 25 securely together.

Further, the tube 25 has a hole at the location near the locking member 221 for a lower portion of the locking member 221 to pass through, and a hole at a location near the deadbolt 24 for the small diameter rod portion 242 of the deadbolt 24 to pass through, Combination of the locking member housing 22 is performed by inserting the locking means 232 and the spring 234 in the tube 25, and the two open ends of the tube 25 are closed with stoppers 253. So when the case 2 is to be formed to surround the locking member 22 and the deadbolt 24, its material may not flow into the tube 25. Thus the locking member housing 22 can be made in this process, which is easy and convenient to assemble.

The operation principle of the second embodiment is that the locking member 221 moves the locking means 232 farther from the deadbolt 24, freeing the deadbolt 24, which is then pushed to move outward by the resilience of the spring 243, unlocking the lock. Then the locking member 221 is rotated to let the locking means 232 move inward to the locked position, ready for the press portion 241 of the deadbolt 24 to be pushed inward to lock next time.

The second embodiment of the lock is simpler than the first embodiment, performing locking and unlocking with the locking member 221, and the deadbolt 24. In order to position the tube 25 and the deadbolt 24 to have a correct center point and convenient for locking, the case 2 is formed to surround the locking member housing 22, the tube 25 and the deadbolt 24 in the same process as the first embodiment. Then the second embodiment also has the same anti-theft function as the first embodiment.

In order to improve conventional locks, the well-known hidden pin tumbler locking mechanism is utilized in the locks in the invention.

Figure 8:
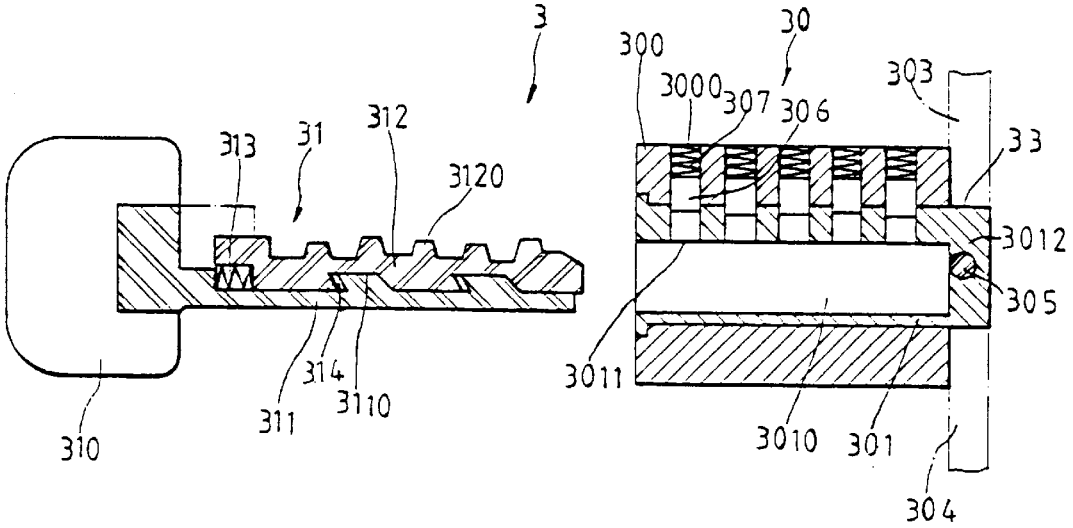
FIG. 8 is a cross-sectional view of a locking member and a key of a third embodiment of a lock in the present invention.
Figure 9:
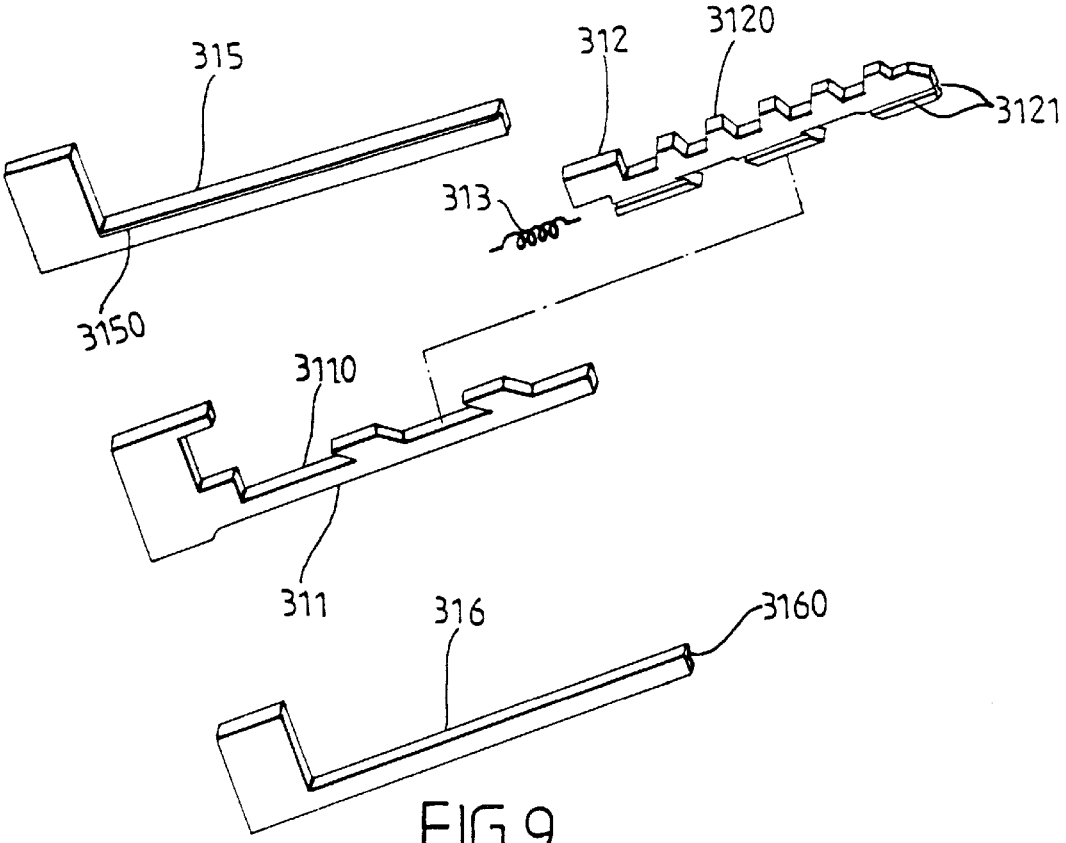
FIG. 9 is an exploded perspective view of the key of the third embodiment of a lock in the present invention.
Figure 10:
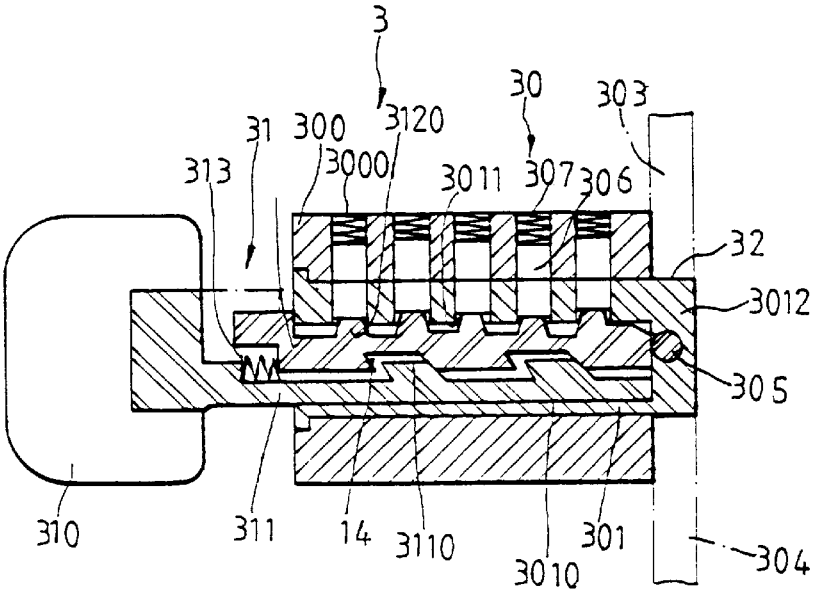
FIG. 10 is a cross-sectional view of the key inserted in the locking member to unlock the lock of the third embodiment in the present invention.

A third embodiment of the lock in the invention is shown in FIGS. 8, 9 and 10, showing a key and a locking member and how to lock and unlock it.

The locking member 3 includes a pin tumbler locking mechanism 30 and a key 31. The pin tumbler locking mechanism 30 consists of an outer cylinder 300, an inner cylinder 301, a stopper 305, a plurality of pins 306, and a plurality of springs 307.

The outer cylinder 300 has a center hole, and a plurality of lateral pin holes 3000 located in parallel and communicating with the center hole.

The inner cylinder 301 is fitted in the outer cylinder 330, having a center key hole 3010 and a plurality of lateral pin holes 3011 respectively aligned to the lateral pin holes 3000 of the outer cylinder 300, a activating means 3012 formed in an inner end to move two pull rods 303, 304 or the same locking rod 23 as that in the first embodiment, in locking and unlocking.

The stopper 305 is provided at an outside of an inner end of the inner cylinder 301.

The plurality of pins 306 are respectively contained in the plurality of pin holes 3000, with a spring 307 urging one end of each pin 306, which has its other end protruding and staying in each pin holes 3011 of the inner cylinder 301 to keep the inner cylinder 301 immovable relative to the outer cylinder 301 while the lock is in the locked position.

The key 31 is to be inserted in the key hole 3010 of the inner cylinder 301, having a plurality of teeth 3120 on one side to push the pins 306 move down in the pin holes 3010 and the contacting line 32 into the pin holes 3000 of the outer cylinder 300. Then the inner cylinder 301 may be rotated by the key 31 from the locked position to the unlocked position. And as the pins 306 have key function surfaces hidden in the pin holes 3011, exterior illegal force cannot pry all the pins 306 retreat at the same time for prying open the lock.

The key 31 has a grip 310, a key body 311, a tooth plate 312 with teeth 3120 to push the pins 36, a spring 313 and two position means 315, 316. The key body 311 extends from the grip 310, having a long groove 3110 with a slope edge in an upper side. The tooth plate 312 is positioned on the key body 311, having its lower side provided with long projections engaging the long grooves 3110 of the key body 311, not falling off the key body 311. The tooth plate 312 has position grooves 3121 respectively at two sides to limit itself to move within a certain distance. The spring 313 has its one end abutting on the grip 310 and the other end a side wall of the tooth plate 312 so as to push the tooth plate 312 or be compressed by the same plate 312. The two position means 315, 316 are long and fixed on two sides of the key body 311, having a projecting-up position strip 3150, 3160 on an inner upper edge.

As shown in FIG. 9, the two position means 315, 316 are fixed at two sides of the key body 311 as if clamping the key body 311, (by fixing means such as welding, adhering, etc.). The tooth plate 312 is located on the key body 311, engaging with the long grooves 3110, restricted lengthwise between the two position means 315, 316. When the tooth plate 312 is moved up, the position strips 3150, 3160 of the position means 315, 316 will engage the position grooves 3121 of the tooth plate 312, preventing the tooth plate 312 from falling off the key body 311. The spring 313 is located between the the key body 311 and the tooth plate 312, preventing the both 311, 312 from sliding off from each other. The tooth plate 312 and the key body 311 is preferably engaged with each other by means of parallel projections and parallel grooves in mutual movement and control. And the plastic grip 310 may be formed integral with the key body 311 for handling.

As shown in FIG. 10, when the key 31 is properly inserted in the key hole 3010, its inner end will be pressed by the stopper 305 to compress the spring 313, with the tooth plate 312 moving along the long groove 3110 and moving upward a certain height, with the teeth 3120 pressing the pins 306 down to move out of the pin holes 3011 to enable the inner cylinder 301 rotatable relative to the outer cylinder 300, i.e. moving in an unlocked position. In this embodiment, the springs 307 and the pins 306 in the pin holes 3000 are positioned in a single side. But from the Figure, it is evident that the tooth plate 312 and the key body 311 may be combined with inclined grooves and projections, and a gap 314 is preferably formed between them. Then the gap 314 can prevent the key body 311 from moving back when the lock is in the unlocked position, with the key 31 smoothly handled.

The key 31 and the pins 306 in the invention do not easily wear off by mutual friction in frequent locking and unlocking, keeping their mutual contact accuracy to prolong their life.

Figure 11:
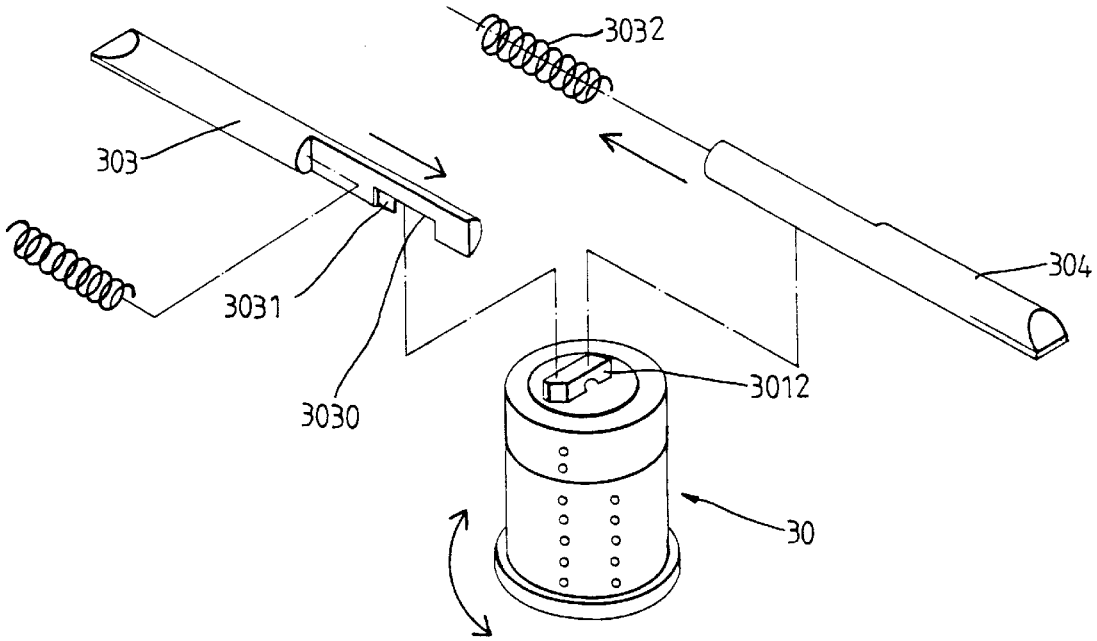
FIG. 11 is a perspective view of a locking rod of the third embodiment of a lock in the present invention.

Next, referring to FIG. 11, the pull rod 303 in the third embodiment has a locking means groove 3030 for the locking means 3012 to fit and rotate therein so that the pull rods 303, 304 may be moved straight and compress press the spring 3032 for locking and unlocking. Further a buffer means 3031 of a proper length is provided in the locking means groove 3030 to contact the tooth plate 312 of the key 31, avoiding inertia of moving back in case that the connect rods 303, 304 should be struck by exterior force. The provision of the buffer means 3031 can prevent this kind of illegal anti-theft action.

Figure 12:
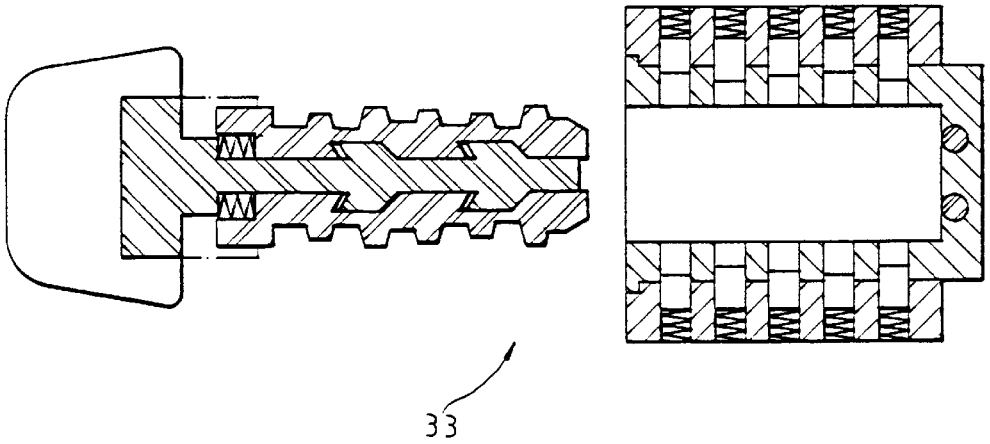
FIG. 12 is a cross-sectional view of a locking member and a key of a fourth embodiment of a lock in the present invention.
Figure 13:
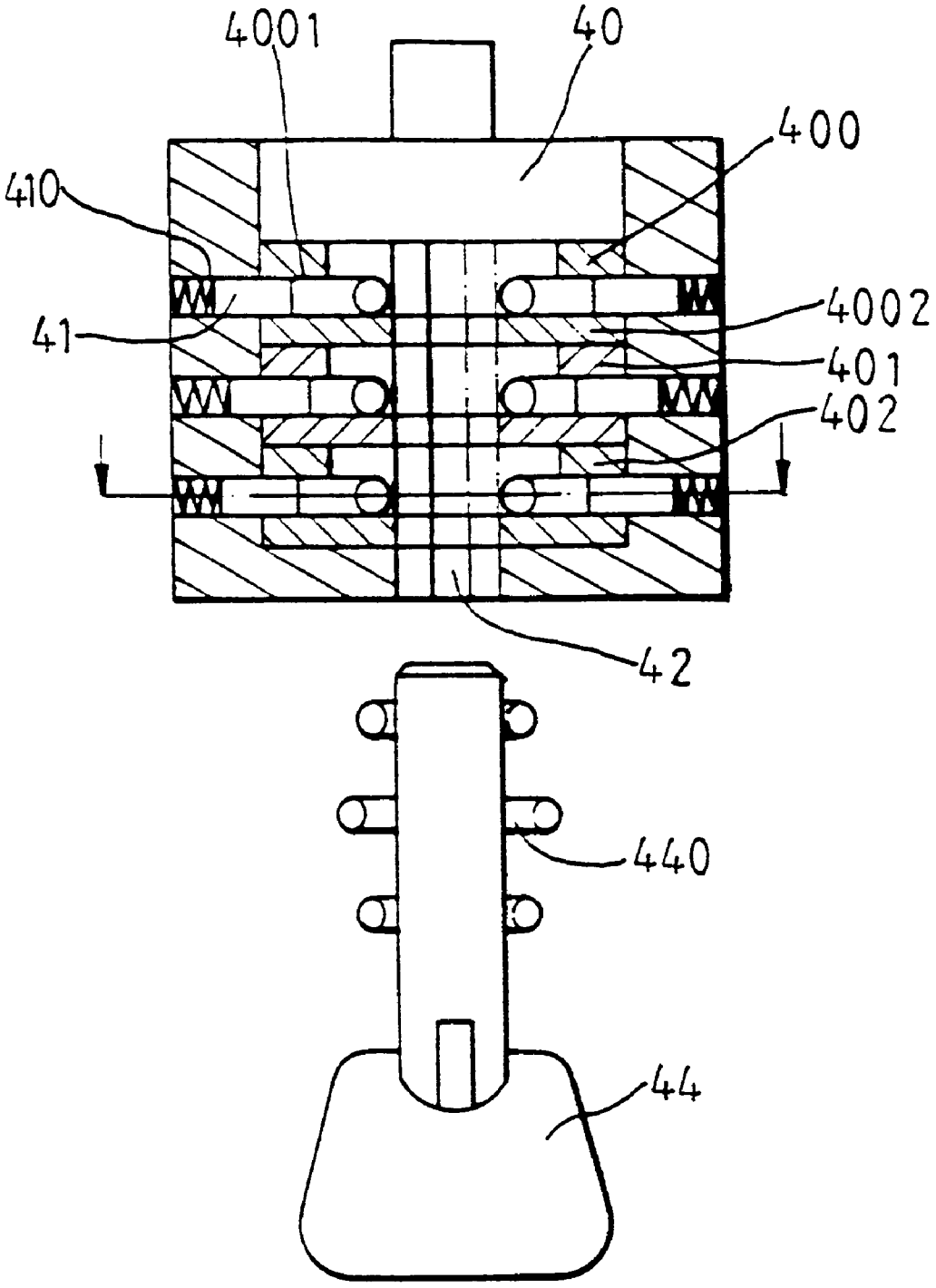
FIG. 13 is a cross-sectional view of a locking member and a key of a fifth embodiment of a lock in the present invention.
Figure 13A:
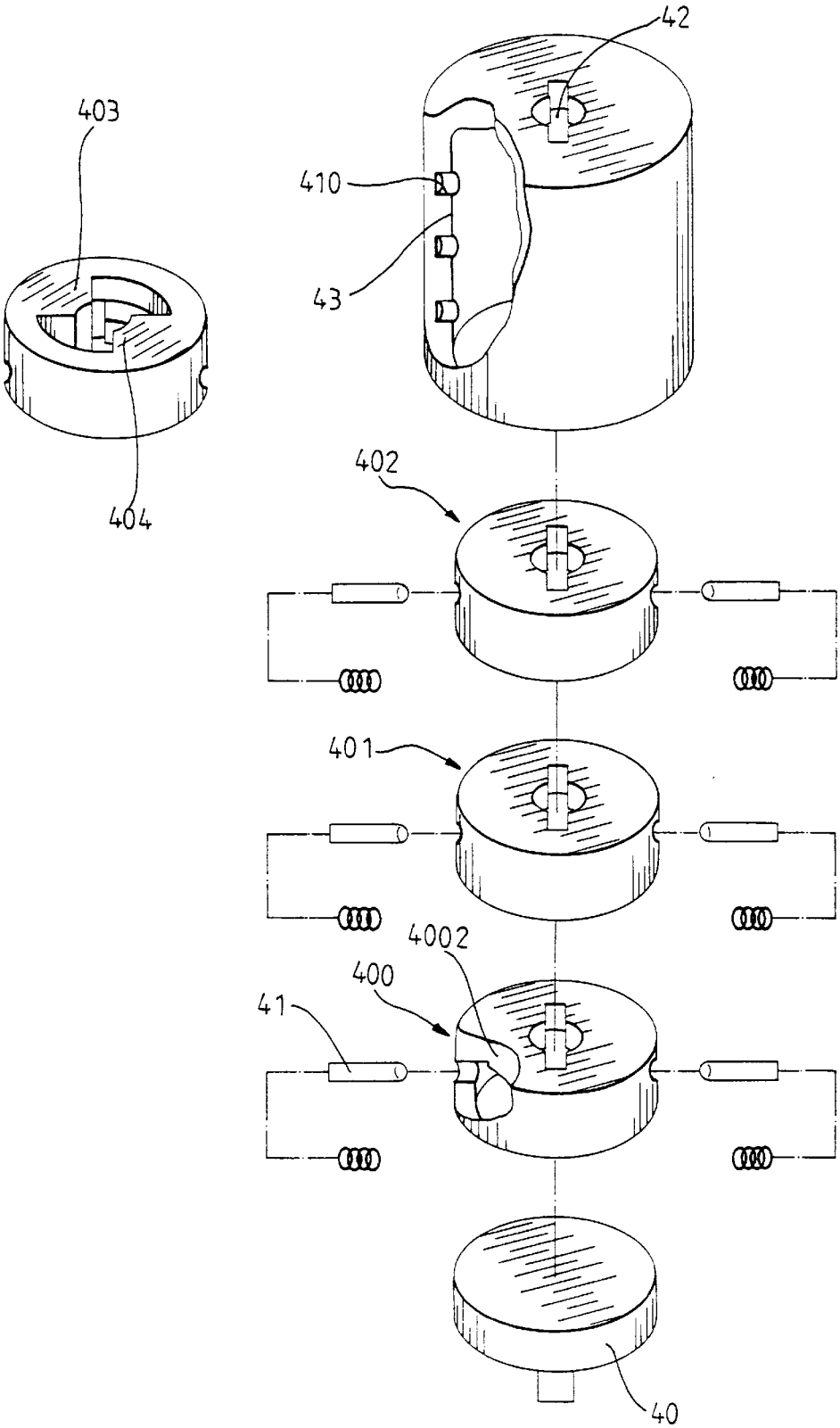
FIG. 13A is an exploded perspective view of an inner cylinder and an outer cylinder of the fifth embodiment of a lock in the present invention.
Figure 14:
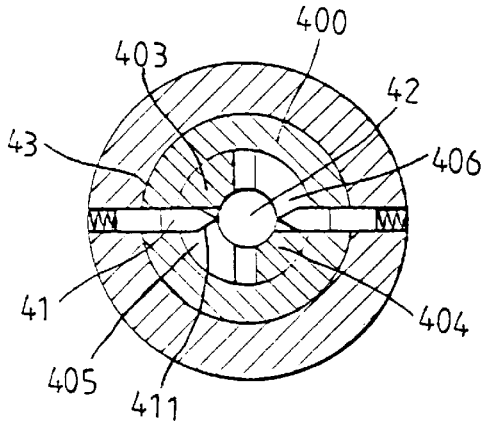
FIG. 14 is a cross-sectional view of the locking member of the fifth embodiment of a lock in the present invention, showing it being in the locked position.
Figure 15:
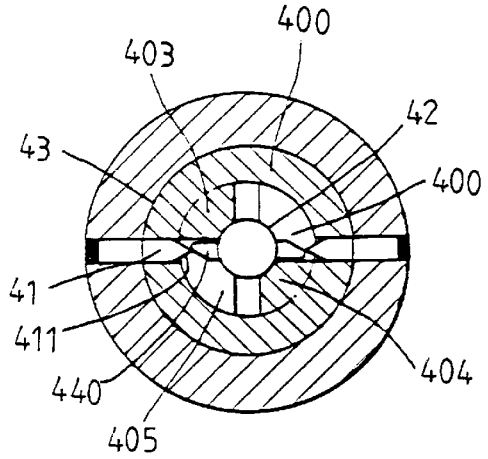
FIG. 15 is a cross-sectional view of the locking member of the fifth embodiment of a lock in the present invention, showing it being in the unlocked position.

A fourth embodiment of the invention is shown in FIG. 12, has the same structure as the third embodiment, except the locking member 33, which has a double pin tumbler locking mechanism instead of a single pin tumbler locking mechanism in the first, the second and the third embodiment.

A fifth embodiment of the invention is shown in FIGS. 13, 13A, 14 and 15, having a different locking member from the other embodiments.

An inner cylinder 40 consists of a plurality of discs 400, 401, 402, and each disc, 400 for example, has a lateral pin hole 4001 corresponding to the pin hole 410 of an outer cylinder, a center key hole 42, and a sealing block 4002 formed in a front half portion and having a key hole 42, and two limit blocks 403, 404 formed in a rear half portion so that the pins 41 may pass through the pin holes 410 and 4001 and then in the hidden areas 405, 406 and in the key hole 42. So this is a kind of pin hiding design and teeth 440 of the key 44 may push the pins 41 to move out of the hidden areas 405, 406 and the contact line 43 to become unlocked. Further, the pins 41 at least have a slope surface in in one side so as to facilitate the teeth 440 of the key 44 push the pins 41 orderly. Further, the limit blocks 403, 404 are for the pins 41 to rest on and for limiting the rotating angle of the key 44. Then the fifth embodiment is equivalent to the first embodiment, in its space condition.

Figure 16:
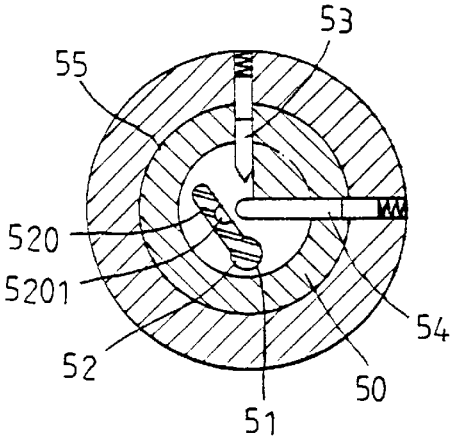
FIG. 16 is a cross-sectional view of the locking member of a sixth embodiment of a lock in the present invention; and, FIG. 17 is an exploded perspective view of the locking member of a seventh embodiment of a lock in the present invention.

A sixth embodiment of the invention is shown in FIG. 16, having an inner cylinder 50 provided with an eccentric key hole 51, a key 52 provided with teeth 520 formed on an end, and each tooth 520 having, a recess 5201 so as to push pins 53, 54 with the tips of the teeth 520 and the recesses 5201 when the key 52 is rotated Then the pins 53, 54 may retreat behind the contacting line 55, i.e. forming the unlocked position.

Figure 17:
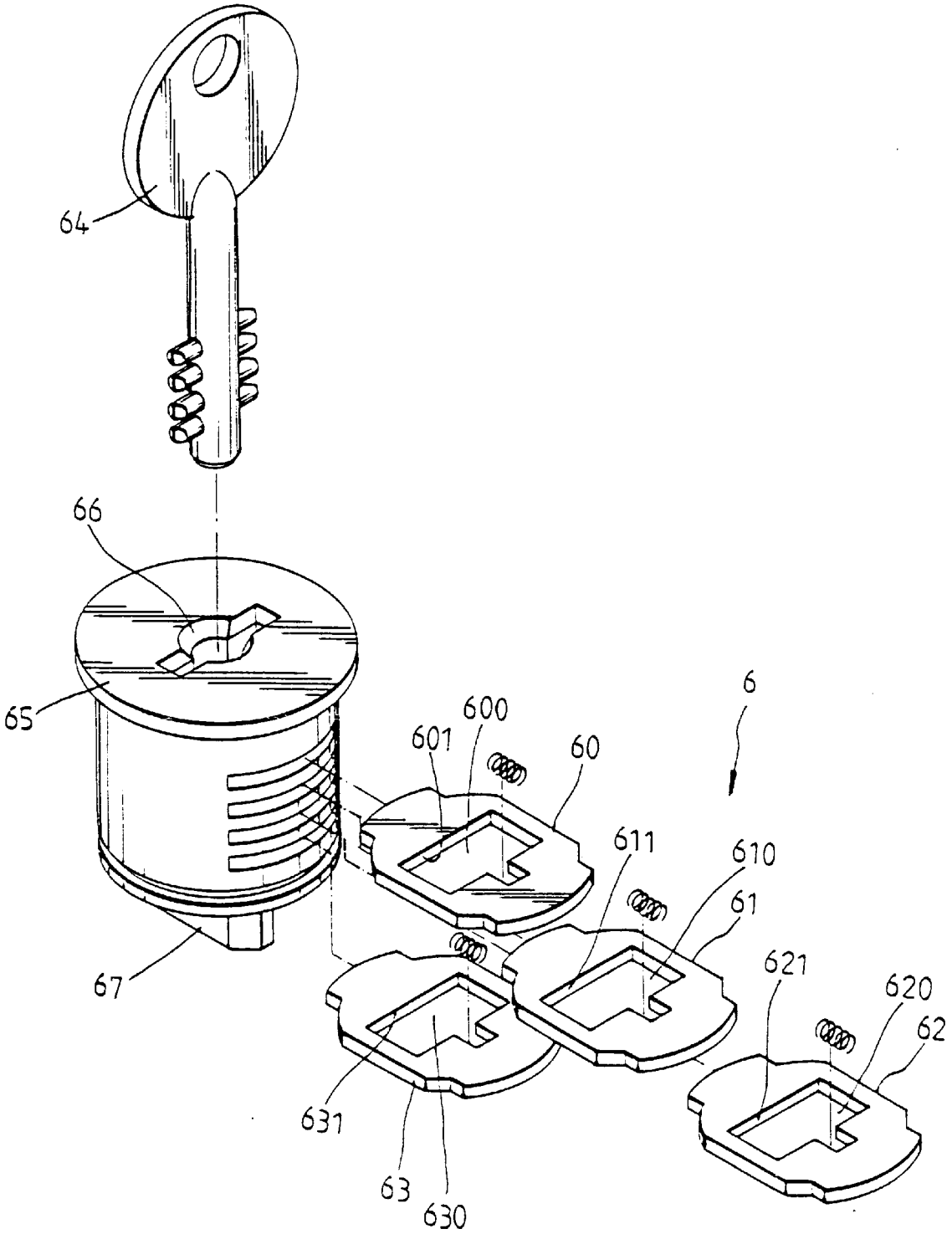

A seventh embodiment of the invention is shown in FIG. 17, having a disc tumbler locking mechanism 6 instead of the pin tumbler locking mechanism used in the first to the six embodiments. Each of thin disc 60, 61, 62, 63 has a key hole 600, 610, 620, 630 differently located from one another, and each key hole 600, 610, 620, 630 has a key controlled side 601, 611, 621, 631 straight and flat. Each key controlled side 601, 611, 621, 631 is not only located in the key hole 600, 610, 620, 630, its can but also be pushed by teeth of the key 64 when the key is inserted in the key hole 66 of an outer cylinder 65. Then the discs all do not engage the outer cylinder 65, permitting a locking means 67 rotated into the locking or unlocking position.

Generally speaking, all the embodiments of the invention have the pin tumblers or the disc tumblers are hidden in the key hole when the lock is in the locked position, preventing the lock from struck or pried open by thefts. Thus the invention improves the traditional lock designs, and may be called as a revolutionary innovation possible to protect sufficiently the pin tumblers or the disc tumblers and keep their accuracy to function well, bettering anti-theft and practical effect.

While the preferred embodiments of the invention have been described above, it will be recognized and understood that various modifications may be made therein and the appended claims are intended to cover all such modifications which may fall within the spirit and scope of the invention.

What is claimed is:

1. A lock comprising:

a case having first and second chambers containing other components of said lock, the case having a slot therethrough configured to accept an item to be locked by the lock;

a generally U-shaped metal shield located within the case adjacent to the slot therethrough to strengthen the case in the area of the slot;

a locking member housing fitted in said first chamber of said case to protect components contained within said locking member housing;

a locking member positioned in said locking member housing, the locking member being movable between a locked position and an unlocked position;

a locking rod connected to an inner end of said locking member so as to move therewith so as to lock or unlock said lock by rotating said locking member; and, a deadbolt movably mounted in said second chamber of said case, having an inner end movable into said first chamber to be engaged with or disengaged from said locking rod.

2. The lock as claimed in claim 1, wherein said locking rod comprises: a transmitting rod portion fixed to said locking member; a locking means provided to abut on said transmitting rod portion; and a recovery spring acting on the locking means, said transmitting rod portion having an inner end fixed firmly with a disc, said disc having a sloped projection provided with a flat surface abutting each other, said locking means having a recess to accommodate said disc, and a buffer fixed on said recess.

3. The lock as claimed in claim 1, wherein said locking member housing has a through hole and a tube is fitted through said through hole, two ends of the tube each being closed with a stop.

4. The lock as claimed in claim 3, wherein said tube has a first hole facing said locking member located for the inner end of said locking member to protrude therein; and a second hole facing said deadbolt for an inner end of said deadbolt to fit through to be inserted in said tube.

5. The lock as claimed in claim 1, wherein said case has a pin extending into the second chamber.

6. The lock as claimed in claim 5, wherein said deadbolt has a press portion with a first diameter; a rod portion extending from said press portion the rod portion having a second diameter smaller than the first diameter, said press portion having a recess for movable engagement by said pin, said rod portion having an annular groove; and a recovery coil spring fitting around said rod portion and bearing on an inner side of said press portion.

7. The lock as claimed in claim 1, wherein said locking member housing in said first chamber of said case has the same shape as the locking member contained therein and is combined securely on said U-shaped metal shield.

8. The lock as claimed in claim 1, wherein said U-shaped metal shield comprises two sidewise inclined projecting walls and an intermediate projecting wall extending between and connected to each of said sidewise inclined projecting walls, the intermediate projecting wall having two aligned holes for said deadbolt to pass through.

9. The lock as claimed in claim 1, wherein said case surrounding said shield is made of a plastic material.

10. The lock as claimed in claim 1, wherein the locking member comprises:

an outer cylinder having a center hole, and a plurality of first pin holes;

an inner cylinder positioned in said center hole of said outer cylinder, the inner cylinder having a key hole, a plurality of second pin holes respectively aligned with said first pin holes of said outer cylinder; a locking means fixed at an inner end of said locking member to move a pull rod for locking and unlocking the lock;

a stopper positioned on an inner end of said inner cylinder;

a plurality of pins, one pin movably located in said plurality of first pin holes of said outer cylinder and said inner cylinder, each pin movable between a locked position wherein the pin extends into both the first and second pin holes to prevent relative movement between the inner and outer cylinders, and an unlocked position wherein the pin does not extend into the second pin hole, thereby permitting relative movement between the inner and outer cylinders;

a spring acting on each of said pins, so as to bias the pins to the locked position, whereby no portion of any pin extends into the keyhole when in the locked or unlocked position;

a key removably insertable into said key hole of said inner cylinder such that when the key is inserted into the keyhole, the key moves said pins in said pin holes of said inner cylinder to the unlocked positions in said outer cylinder enabling said inner cylinder to move relative to said outer cylinder.

11. The lock is claimed in clam 10, wherein said key comprises:

a grip;

a key body combined with and extending from one end of said grip, the key body formed with a plurality of grooves on an upper side the grooves having sloped sides;

a tooth plate movably located on said key body and having a plurality of sloped projections on a lower side engaged with said plurality of grooves on said key body and having a plurality of teeth formed on an upper side for pushing said pins; and a spring located to have one end resting on said grip and the other end resting on said tooth plate so that said spring pushes against said tooth plate; whereby when said key is inserted in said key hole, said tooth plate contacts said stopper to compress said spring, causing said tooth plate to move to said grip and up along the sloped sides of said grooves of said key body so that said teeth of said tooth plate push said pins in said pin hole into said outer cylinder thereby permitting said inner cylinder to move relative to said outer cylinder to change a locked position into an unlocked position.

12. The lock claimed as in claim 10, wherein said inner cylinder comprises a plurality of discs, each of said discs having at least one of the second pin holes aligned with said first pin hole of said outer cylinder and the key hole, each disc further having a front half portion with said key hole and a rear half portion having two limit blocks, said pins extending in said first pin holes of said outer cylinder and in said second pin holes of said discs whereby, when said key is inserted into said keyhole, said tooth plate of said key pushes said pins to the unlocked positions when said key is rotated by a predetermined angle, and said limit blocks limiting a rotating angle of said key.

13. The lock as claimed in claim 1, wherein the locking member comprises:

an outer cylinder having a center hole, and a plurality of lateral holes;

a plurality of thin discs movable between locked and unlocked positions, each disc having a key hole located differently from the other disks, a key contact surface of each disc being smooth and flat and not protruding in said key hole when the discs are in the locked positions; and a key removably insertable into said key holes of said plurality of discs such that when the key is inserted into the key hole and rotated, the key pushes said key contact surfaces of said discs to move the plurality of discs to the unlocked positions.

* * * * *